US012245694B2

(12) United States Patent
Bechter

(10) Patent No.: US 12,245,694 B2
(45) Date of Patent: Mar. 11, 2025

(54) SELF-RETRACTING DEVICE

(71) Applicant: FULTERER AG & CO KG, Lustenau (AT)

(72) Inventor: Matthias Bechter, Lauterach (AT)

(73) Assignee: FULTERER AG & CO KG, Lustenau (AT)

( * ) Notice: Subject to any disclaimer, the term of this patent is extended or adjusted under 35 U.S.C. 154(b) by 93 days.

(21) Appl. No.: 18/008,533

(22) PCT Filed: May 5, 2021

(86) PCT No.: PCT/EP2021/061824
§ 371 (c)(1),
(2) Date: Dec. 6, 2022

(87) PCT Pub. No.: WO2021/249699
PCT Pub. Date: Dec. 16, 2021

(65) Prior Publication Data

US 2023/0210260 A1 Jul. 6, 2023

(30) Foreign Application Priority Data

Jun. 10, 2020 (AT) ..... A 128/2020

(51) Int. Cl.
*A47B 88/467* (2017.01)
*A47B 88/473* (2017.01)

(52) U.S. Cl.
CPC ..... *A47B 88/467* (2017.01); *A47B 88/473* (2017.01)

(58) Field of Classification Search
CPC ..... A47B 88/467; A47B 88/047; A47B 88/46; A47B 88/473; A47B 88/477; A47B 2088/4675; A47B 2088/0474
See application file for complete search history.

(56) References Cited

U.S. PATENT DOCUMENTS 10,758,043 B2 * 9/2020 Pohlmann ..... A47B 88/467
2006/0113169 A1 * 6/2006 Leon ..... A47B 88/467 200/5 R (Continued)

FOREIGN PATENT DOCUMENTS

AT 521511 B1 2/2020
DE 20308218 U1 9/2004

(Continued)

OTHER PUBLICATIONS

International Search Report and Written Opinion with English translation mailed Aug. 16, 2021 for International Application No. PCT/EP2021/061824, 11 pages.

*Primary Examiner* — Andrew Roersma
(74) *Attorney, Agent, or Firm* — Dickinson Wright PLLC

(57) ABSTRACT

A self-retracting device for a furniture part which can be extracted from a furniture carcass in an extraction direction by a telescopic drawer slide is provided. The self-retracting device comprises: a carriage slidably supported; a retraction spring loading the carriage into a basic position, the carriage being slidable, by being coupled to a driver; and a damping unit for damping the sliding movement of the carriage from a standby position into a basic position. The carriage is coupled to a movable part of the damping unit by way of an arm which can pivot relative to the carriage about a first pivot axis and relative to the damping unit about a second pivot axis. When the carriage is slidingly moved by the retraction spring over a retraction path, at least in an end portion of the retraction path, the arm is rotated about an axis perpendicular to the extraction direction.

10 Claims, 12 Drawing Sheets

(56) References Cited

U.S. PATENT DOCUMENTS

| | | | | |
|---|---|---|---|---|
| 2018/0132615 | A1* | 5/2018 | Kim | F16C 29/02 |
| 2022/0232973 | A1* | 7/2022 | Lobbezoo | A47B 88/40 |

FOREIGN PATENT DOCUMENTS

| | | | | |
|---|---|---|---|---|
| WO | 2008119091 | A1 | 10/2008 | |
| WO | WO-2010143352 | A1 * | 12/2010 | A47B 88/047 |

* cited by examiner 5
6
8
9
9b
9c
10
14
15
16
17
18
22
22a
22b
5a

SELF-RETRACTING DEVICE

This U.S. national phase patent application claims priority to international patent application no. PCT/EP2021/061824, filed May 5, 2021, which claims the benefit of Austria patent application no. A 128/2020, filed Jun. 10, 2020, the entire contents of which are incorporated herein by reference in their entirety.

BACKGROUND

1. Technical Field

The invention relates to a self-retracting device for a furniture part which can be extracted from a furniture carcass in an extraction direction by means of an extracting guide and inserted into the furniture carcass against the extraction direction, comprising a carriage slidably supported by a base body from a basic position into a standby position, a retraction spring loading the carriage into the basic position, wherein the carriage is slidable by being coupled with a driver displaceable in the extraction direction against the force exerted by the retraction spring from the basic position into the standby position, in which the driver can be uncoupled from the carriage and in which the carriage is retained against the force of the retraction spring, and a damping unit for damping the sliding movement of the carriage from the standby position into the basic position, which comprises a part which is movable into and against the extraction direction and which is coupled with the carriage.

2. Related Art

Such self-retracting devices are usually integrated into extracting guides. For example, a self-retracting device of this kind emerges from WO 2008/119091 A1. The damping unit used to damp the retraction motion is formed by a pneumatic piston-cylinder unit. Damping units also constituted in a different way have already been used in self-retracting devices, for example rotation dampers. In order that the extraction of the extractable furniture part from the completely inserted state of the extractable furniture part is not hindered by the damping unit, the damping unit preferably works only in the direction of insertion. In order not to hinder the retraction over the end portion of the retraction movement before reaching the fully inserted state of the extractable furniture part, so that the completely inserted state of the extractable furniture part is reliably reached, conventional piston-cylinder units used for the damping also comprise a free-run over the last portion of the insertion of the piston into the cylinder. However, in order to obtain a sufficient damping path, so that even with a forceful push of the extractable furniture part, the latter is reliably slowed down even in the fully laden state, the installation length of the piston-cylinder unit required overall is enlarged by such a free-run at the end of the retraction path. The overall installation length of the self-retracting device, however, is thus also increased. The effect of this with integration into an extracting guide is that the extractable rails have to be constituted correspondingly shorter. Part of the extraction length of the extraction device is thus lost.

In order to increase the retraction force of the self-retracting device in the last portion of the retraction path, the retraction spring engages with a lever according to the teaching of AT 521 511 B1 which can pivot relative to the carriage and relative to the base body of the self-retracting device. The pivot axis relative to the base body is slidable here with respect to the lever and with respect to the base body, in particular by means of a slotted link arranged in the lever or in the base body, into which a guide pin constituting the pivot axis engages. The course of the retraction force exerted by the retraction spring on the carriage can thus be adapted depending on the position of the carriage.

SUMMARY

An advantageous self-retracting device of the type mentioned at the outset, which has a relatively small installation length with a relatively long retraction path, is needed. According to the invention, this is achieved by a self-retracting device with features disclosed here.

In the self-retraction device according to the invention, the carriage is coupled with the movable part of the damping unit by way of an arm. This arm can be pivoted relative to the carriage about a first pivot axis and relative to the damping unit about a second pivot axis. The first pivot axis can be moved slidably relative to the arm or the carriage and/or the second pivot axis can be moved slidably relative to the arm or the movable part of the damping unit. The arm is guided by the base body between a rear end position, which the arm occupies in the basic position of the carriage, and a front end position, which the arm occupies in the standby position of the carriage. When the carriage is slidingly moved from the standby position into the basic position, a rotation of the arm about an axis running perpendicular to the extraction direction takes place at least in an end portion of the movement of the arm before it reaches its rear end position (=in an end portion of the retraction path). Over this end portion of the movement of the arm before it reaches the rear end position, the distance by which the carriage is slidingly moved is thus greater that the distance by which the movable part of the damping unit is slidingly moved, preferably by more than twice as much. The damping force exerted by the damping unit on the carriage over the end portion of the retraction path is thus reduced, preferably to less than half.

Free-run of the damper in the end portion of the movement of the carriage from the standby position into the basic position can thus be reduced or preferably completely eliminated. The required installation length of the damper can thus be shortened.

The damper is preferably constituted in the form of an, in particular, pneumatically operating piston-cylinder unit.

To guide the arm, the base body advantageously comprises a slotted link, into which at least one guide pin of the arm engages. Preferably, two guide pins of the arm engage in this slotted link, in order to guide the combined sliding movement and rotation of the arm. In a modification, an elongated guide pin of the arm could also be provided, which engages in the slotted link of the base body, or two slotted links of the base body could be provided, in which a respective guide pin of the arm engages.

An advantageous embodiment of the invention makes provision such that the retraction spring engages with a spring lever, which can pivot relative to the base body about a first pivot axis and relative to the carriage about a second pivot axis, wherein the first pivot axis can be moved slidably relative to the base body or relative to the spring lever. The transmission of the spring force onto the carriage can thus be modified over the retraction path of the carriage. In particular, the force acting on the carriage in the end portion of the sliding movement of the carriage from the standby position into the basic position (=over the end portion of the retraction path) can be increased, in order to ensure the completely retracted state of the extractable furniture part.

In a possible embodiment of the invention, the carriage comprises a tilting part mounted pivotably about a tilting axis between an engagement position and a release position. In the basic position of the carriage, the tilting part occupies the engagement position and the driver is coupled with the tilting part. For this purpose, the driver can engage in a recess of the tilting part located in the engagement position. The driver could also comprise a recess, into which a projection of the tilting part engages. In the standby position of the carriage, the tilting part is tilted into the release position. In the latter, an uncoupling of the driver from the tilting part, for example by removing the driver from the recess of the tilting part, is enabled and the tilting part is retained by the base body against a sliding movement against the extraction direction. The tilting part thus also forms a retention device for retaining the carriage in the standby position, when the carriage is uncoupled from the driver. Other embodiments of such a retention device are possible and known. For example, in the end portion of the sliding movement before reaching the standby position, the carriage itself could be tilted about an axis running perpendicular to the extraction direction (by a correspondingly curved guidance of the base body), so that the driver can also be removed from a recess in the carriage, and the carriage can be retained against a sliding displacement against the extraction direction directly by abutting against a retention surface of the base body.

When mention is made in this description of "front" and "rear", this is related to the extraction direction.

Further advantages and details of the invention will be explained in the following with the aid of the accompanying drawing. In the figures:

DETAILED DESCRIPTION OF EXAMPLE EMBODIMENTS

A first example of embodiment of the invention is represented in FIGS. 1 to 28. The self-retracting device is integrated into an extracting guide, which in the example of embodiment shown comprises a carcass rail 1, a middle rail 2 and an extraction rail 3. The extracting guide is constituted here in the manner of a differential extracting guide, in which middle rail 2 travels respectively half the path of extraction rail 3 during the extraction and insertion. As represented, all the runner rollers can be arranged on middle rail 2. The extracting guide can be constituted in a conventional manner and the arrangement of the runner rollers and their of functioning does not need to be explained in greater detail here.

A self-retracting device according to the invention can also be integrated into different kinds of telescopic driver slides, for example also into a telescopic driver slide which comprises only a carcass rail and an extraction rail.

The extraction of extraction rail 3 from the completely inserted state takes place in an extraction direction 4, insertion of extraction rail 3 opposite the extraction direction 4.

Figure 1:
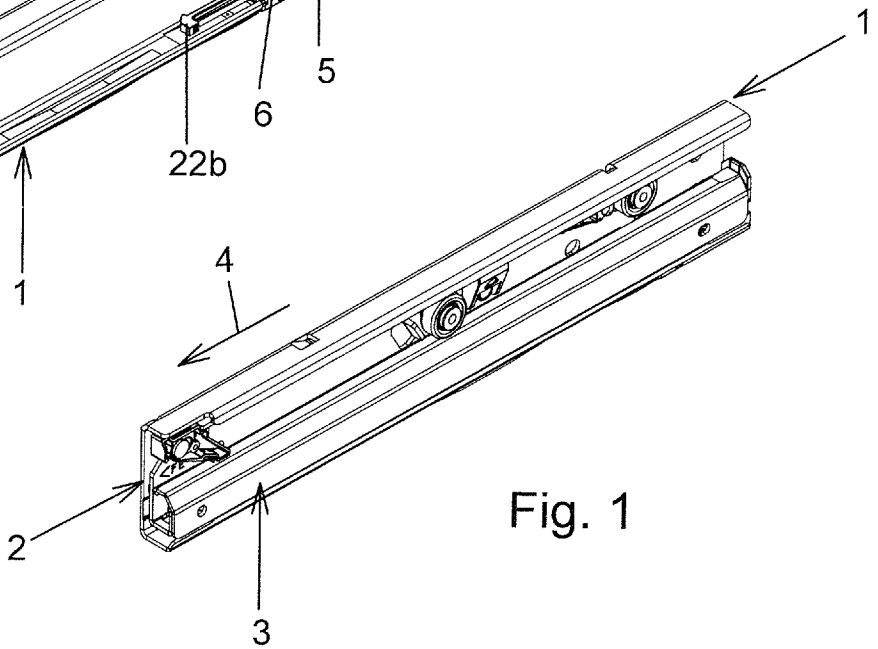
FIG. 1 shows an extracting guide with an integrated self-retracting device according to an example of embodiment of the invention, in the inserted state of the extracting guide.
Figure 2:
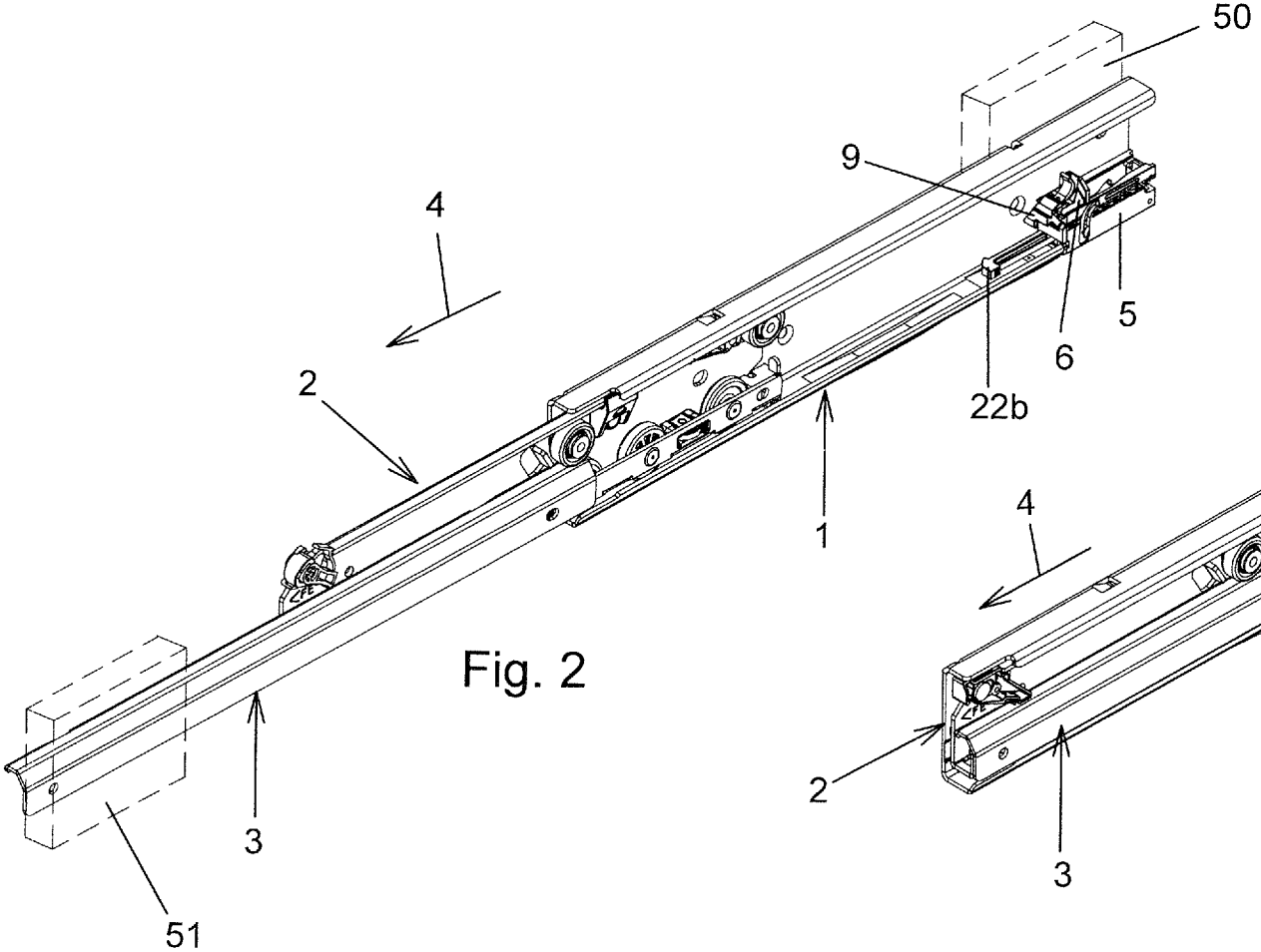
FIG. 2 shows an oblique view corresponding to FIG. 1 in an extracted state of the extracting guide.
Figure 4:
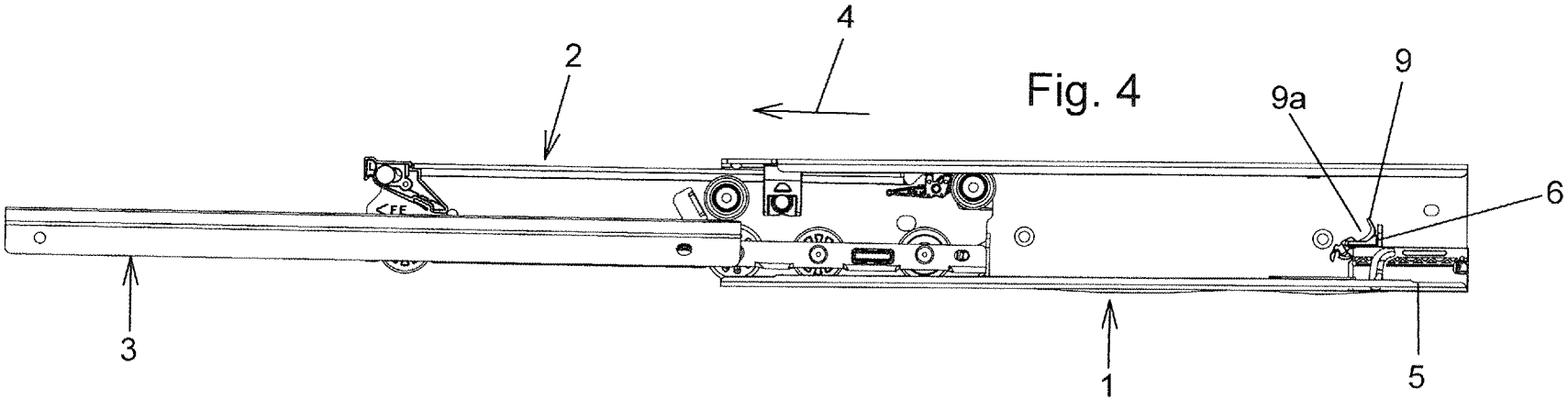
FIGS. 3 and 4 show side views of the extracting guide in the retracted and extracted state.
Figure 3:
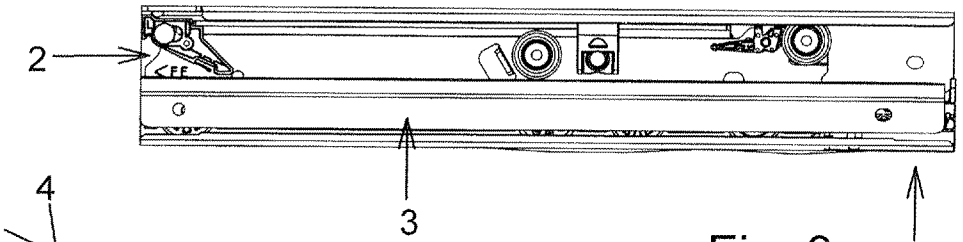

Parts of a furniture carcass 50, in which the carcass rail 1 is to be assembled, and of an extractable furniture part 51, on which extraction rail 3 is to be assembled, are only indicated with a dashed line in FIG. 2.

The self-retracting device comprises a base body 5, by which carriage 6 is slidably loaded parallel to extraction direction 4 between a basic position (FIGS. 7, 9, 13, 17, 21 and 25) and a standby position (FIGS. 8, 10, 16, 20, 24 and 28).

For the slidable guidance of carriage 6, the latter comprises grooves 7 on each side, into which webs 8 of base body 5 directed towards one another and running parallel to extraction direction 4 engage. For example carriage 6 could also comprise projecting guide pins for the slidable guidance on base body 5, which engage in slotted links in the base body constituted for example in the form of elongated holes.

A tilting part 9 is mounted pivotably (=rotatably) about a tilting axis 10 (which could also be referred to as a pivot or rotation axis). In the basic position of carriage 6, tilting part 9 occupies an engagement position relative to its pivoting about the tilting axis 10, in the standby position of carriage 6 a release position. Tilting axis 10 can be constituted for example by means of axle pins 11 of tilting part 9, which engage in axle recesses 12 of carriage 6.

Tilting axis 10 runs perpendicular to extraction device 4 and preferably lies horizontal.

A retraction spring 13 engages with a spring lever. Spring lever 14 can be pivoted relative to base body 5 about a first pivot axis 15 and relative to carriage 6 about a second pivot axis 16. First pivot axis 15 can be slidably moved relative to base body 5 and is immovable relative to the spring body. Second pivot axis 16 is immovable relative to carriage 6 and relative to the spring lever. For the sliding movement of first pivot axis 15 relative to base body 5, provision can be made for example such that spring lever 14 comprises an axle pin 17, which engages in a spring-lever slotted link 18 of base body 5 formed here by a curved elongated hole. Retraction spring 13 engages with a fastening pin 19 of spring lever 14, which lies between first and second pivot axes 15, 16.

Second pivot axis 16 is formed for example by axle pins 20 of spring lever 14, which engage in axle recesses 21 of tilting part 9.

First and second pivot axes 15, 16 lying parallel to one another run perpendicular to extraction device 4 and preferably lie horizontal.

As a result of the engagement of the retraction spring with spring lever 14 in connection with the sliding movement of the first pivot axis in a corresponding direction (which in addition can also change depending on the position of the carriage), the change in the transmission of the spring force acting on the carriage is achieved depending on the position of the carriage. Over a portion of the path of the sliding movement of the carriage following the basic position of the carriage, a greater change in the length of the spring takes place than over the same portion of the path of the sliding movement of the carriage when the latter is closer to the standby position. Over the last portion of the retraction path before the carriage reaches the basic position, the spring force acting on the carriage can thus be increased compared to a direct engagement of the retraction spring on the carriage.

A damping unit 22 is used to damp the sliding movement of carriage 6 from the standby position into the basic position. As a damper, the latter comprises, for example, a hydraulically pneumatically-acting piston-cylinder unit 22*a*. The cylinder is immovably connected to base body 5. The piston rod is connected to a movable part 22*b* of the damping unit, which is guided with a sliding movement from base body 5 parallel to extraction direction 4. Only the movement of the movable part 22*b* against extraction direction is damped by piston-cylinder unit 22*a*, whilst the movement of movable part 22*b* is undamped in the opposite direction. Such in particular pneumatically acting dampers having a free-run in the movement direction are known.

A kinematically reversed arrangement of the piston-cylinder unit is also conceivable and possible, so that the piston rod is immovable relative to base body 5 and the cylinder can be slidably moved and is connected immovably to a movable part of the damping unit.

Movable part 22*b* of damping unit 22 is coupled with carriage 6 by way of an arm 23. Arm 23 is pivoted (=rotated) relative to carriage 6 about a first pivot axis 24 and relative to movable part 22*b* of damping unit 22 about a second pivot axis 25. Second pivot axis 5 can for example, as represented, be formed by an axle pin 26 of movable part 22*b* of damping unit 22, which engages in an axle recess 27 of arm 23. First pivot axis 24 can be formed for example, as representated, by an axle pin 28 of carriage 6, which engages in an elongated hole 29 of arm 23.

First pivot axis 24 can be moved slidably relative to arm 23 and is immovable relative to carriage 6, whereas second pivot axis 25 is immovable relative to arm 23 and relative to movable part 22*b* of damping unit 22.

First and second pivot axes 24, 25 lying parallel to one another run perpendicular to extraction direction 4 and preferably lie horizontal.

Arm 23 is supported movably by base body 5 between a rear end position and a front end position. The rear end position is occupied by arm 23 in the basic position of carriage 6. The front end position is occupied by arm 23 in the standby position of carriage 6. In the front end position, arm 23 is moved slidably in the extraction direction relative to the rear end position and is pivoted, in the example of embodiment, about a horizontal axis running perpendicular to extraction direction 4. This axis, about which arm 23 is pivoted in the front end position relative to the rear end position, is formed by second pivot axis 25 in the example of embodiment.

To guide arm 23, base body 5 has a slotted link 30, into which first and second guide pins 31, 32 of arm 23 engage.

In a rear end portion of slotted link 30, slotted link 30 comprises protrusions towards the bottom and towards the top, in which guide pins 31, 32 lie in the rear end position of arm 23.

In the example of embodiment shown, slotted link 30 comprises protrusions towards the bottom and towards the top also in a front end portion, in which guide pins 31, 32 lie in the front end position of arm 23.

Figure 5:
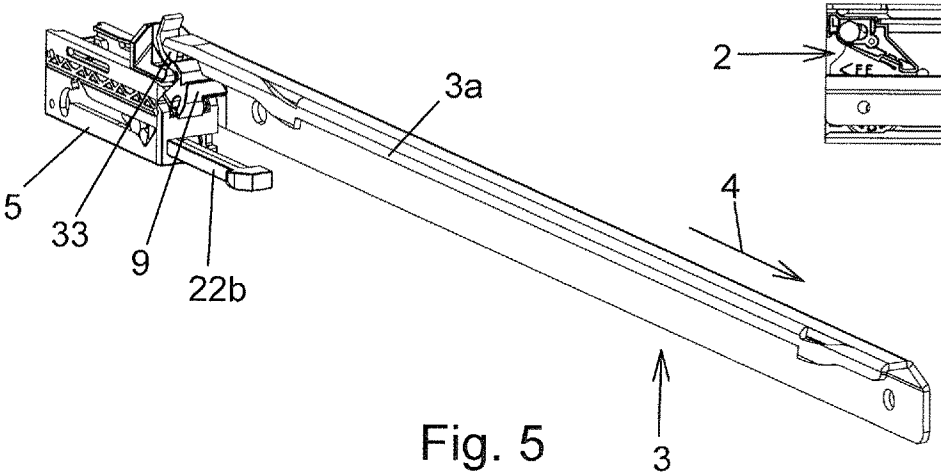
FIG. 5 shows an oblique view of the extraction rail and the self-retracting device on an opposite side, the middle rail and carcass rail omitted.
Figure 6:
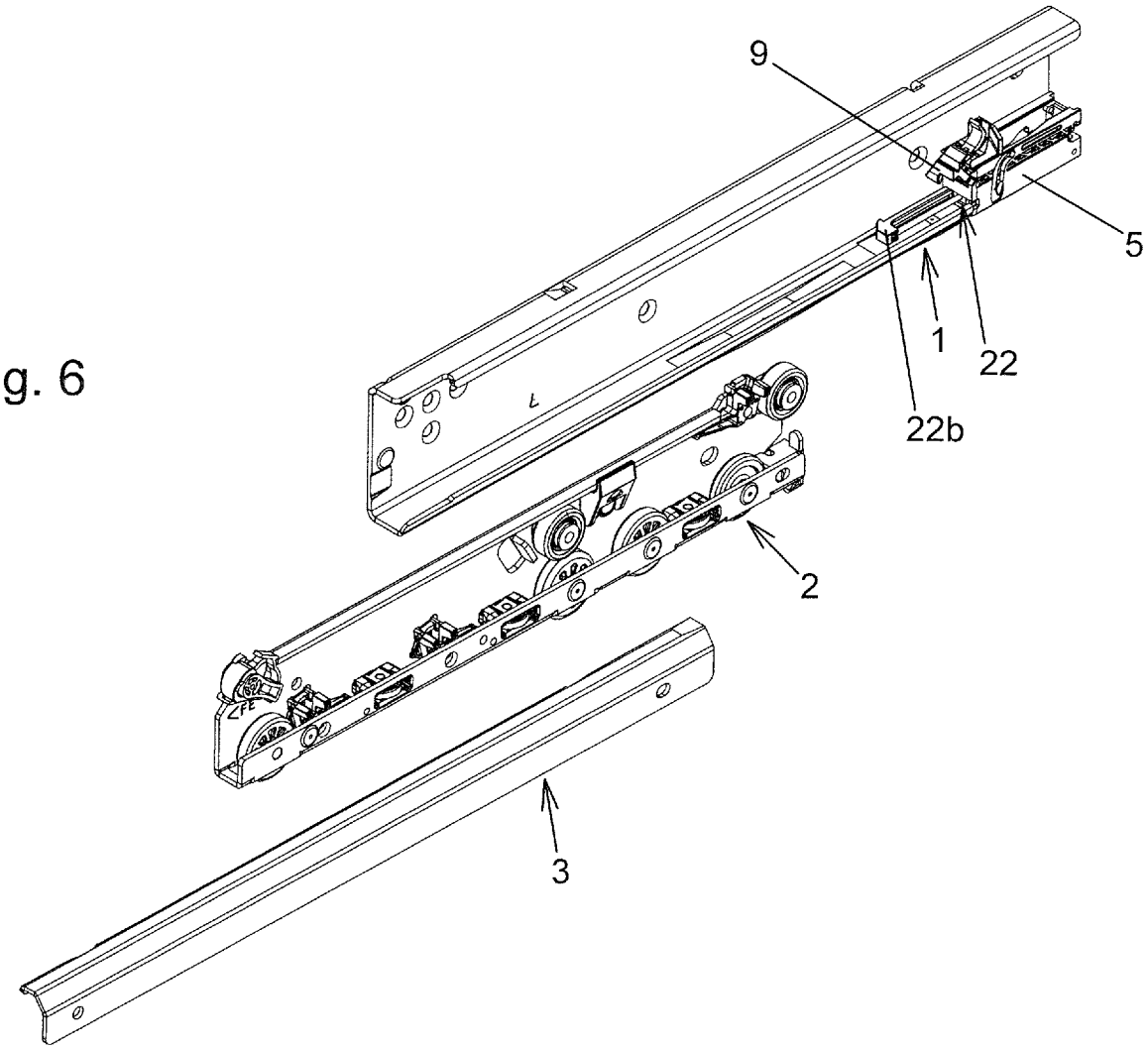
FIG. 6 shows an oblique exploded view of the rails of the extracting guide.
Figures 7, 8:
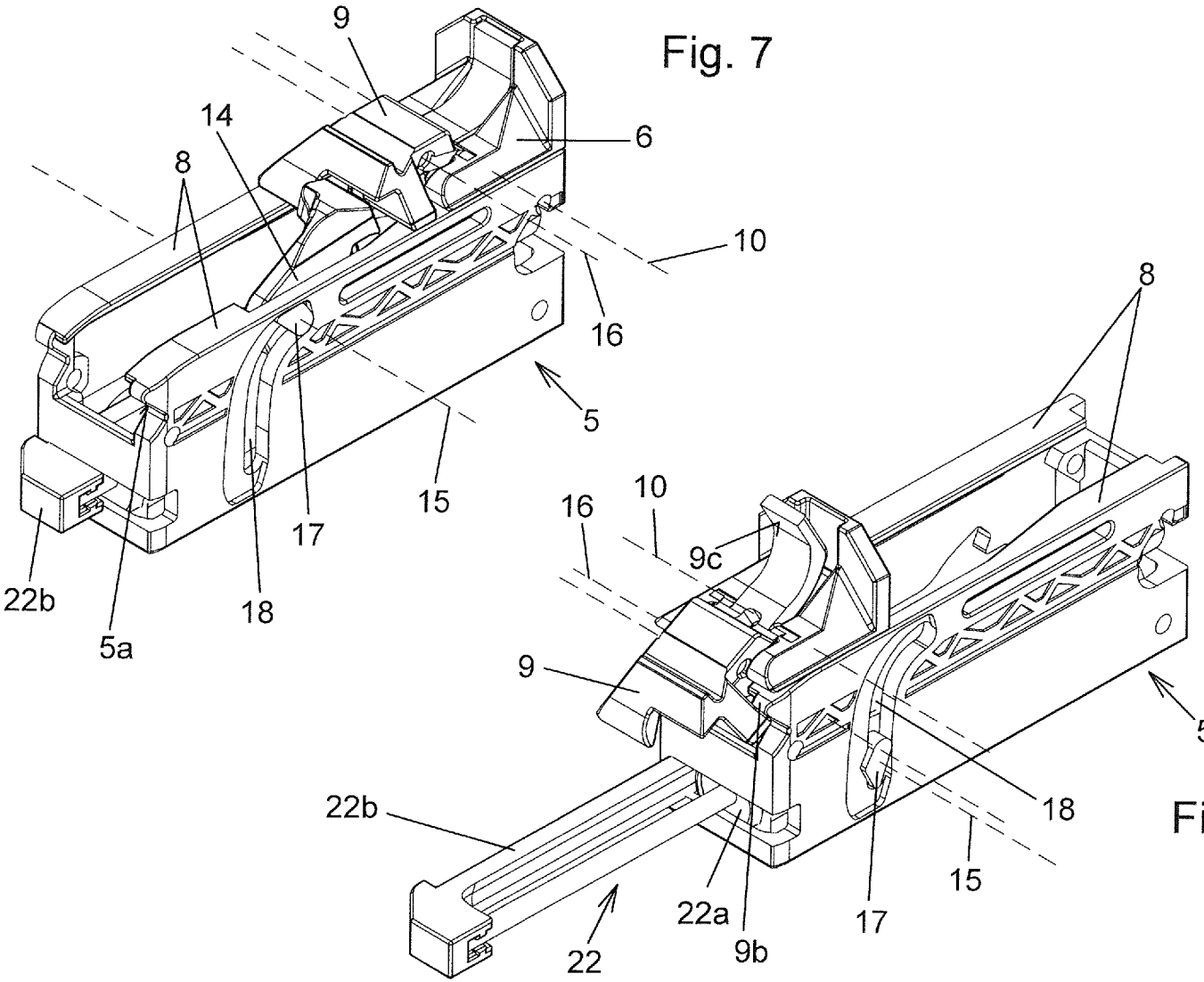
FIG. 7 shows an oblique view of the self-retracting device in the basic position of the carriage.
FIG. 8 shows an oblique view corresponding to FIG. 7, in the standby position of the carriage.
Figure 9:
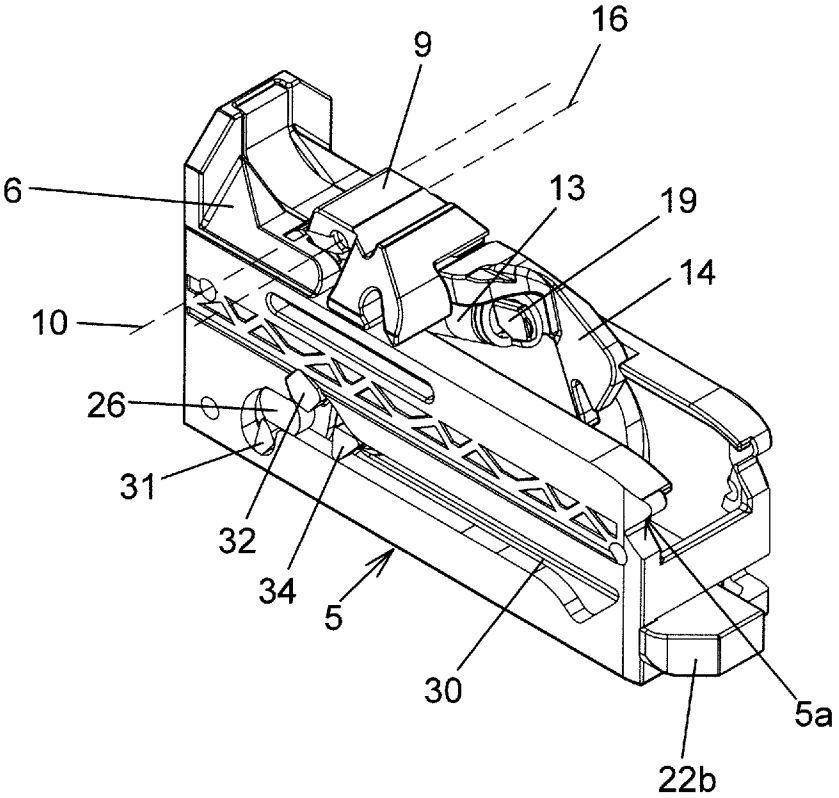
FIGS. 9 and 10 show oblique views of the self-retracting device in the basic position and standby position of the carriage from a different viewing direction.
Figure 10:
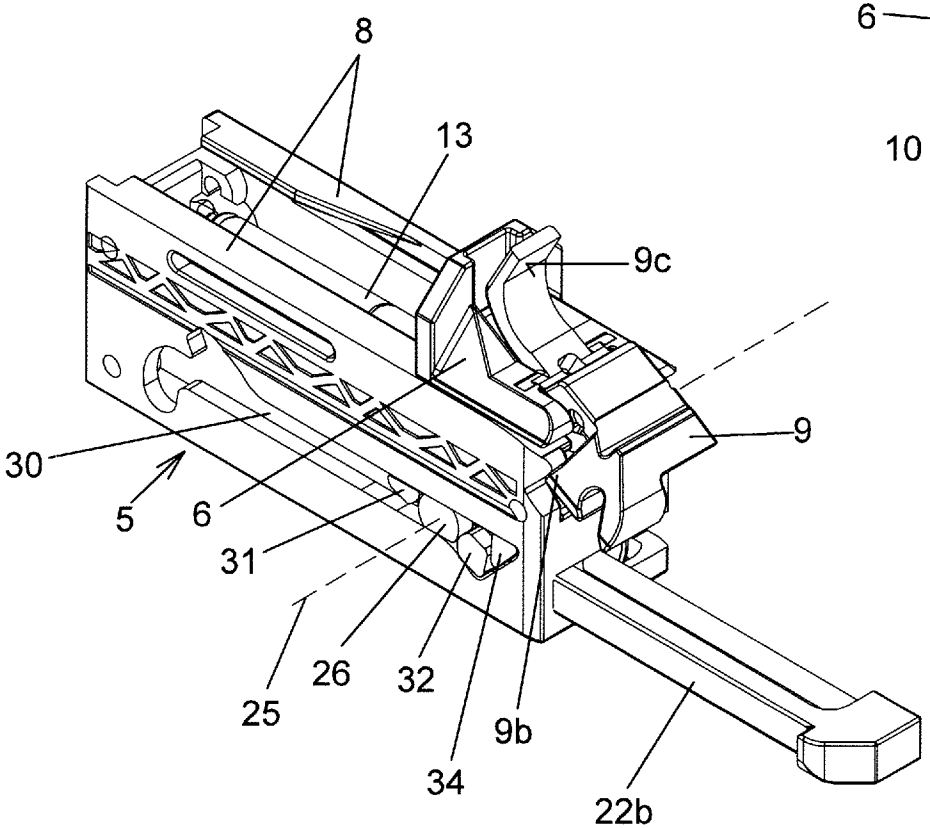
Figure 11:
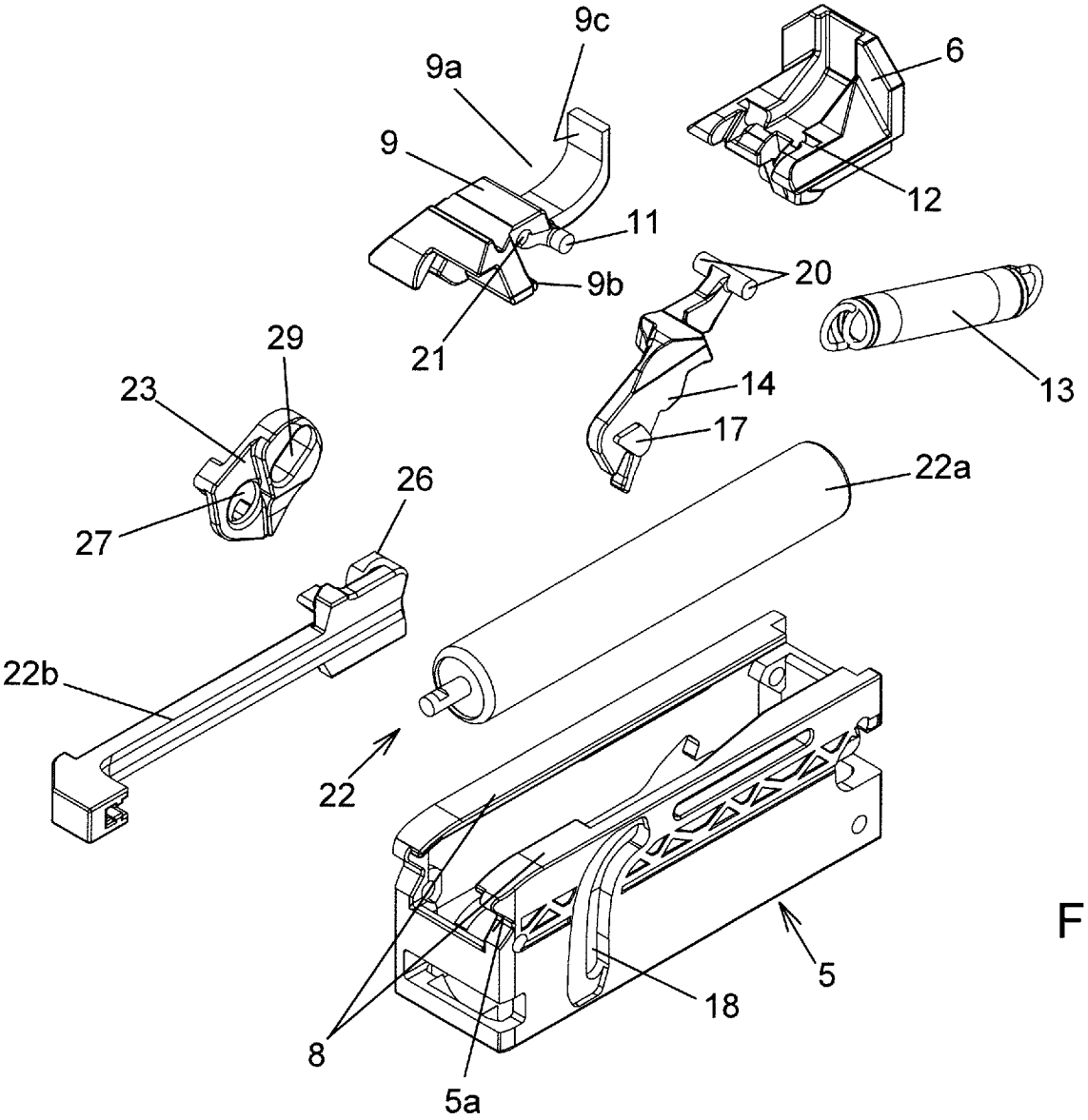
FIGS. 11 and 12 show exploded representations of the self-retracting device from different viewing directions.
Figure 12:
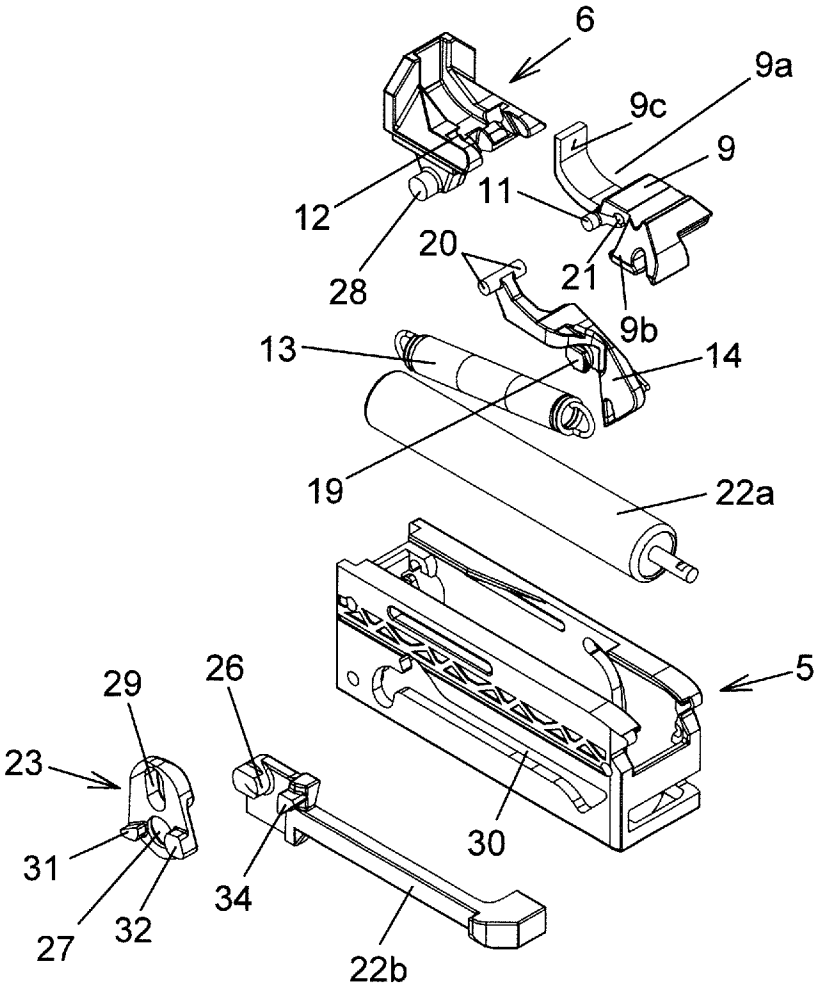
Figure 15:
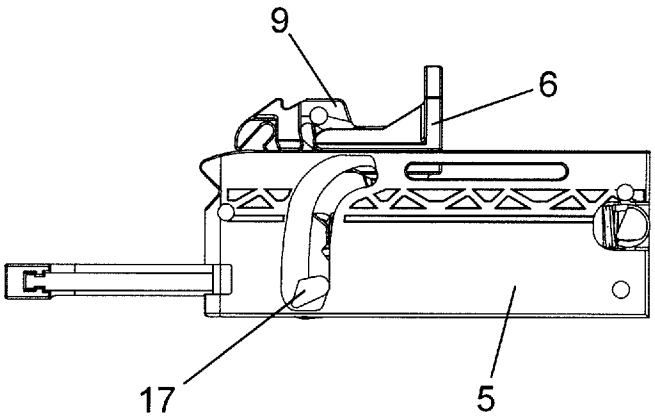
FIG. 15 shows a side view of a second intermediate position of the carriage slidably moved further in the extraction direction relative to FIG. 14.
Figure 16:
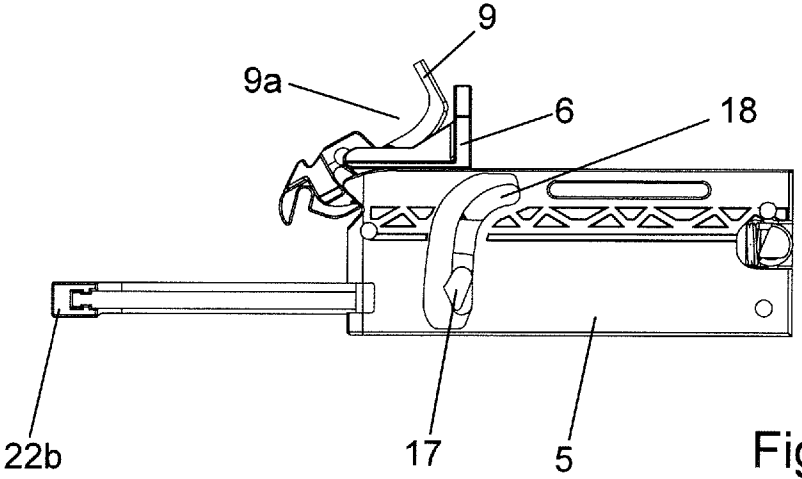
FIG. 16 shows a side view in the standby position of the carriage.
Figure 13:
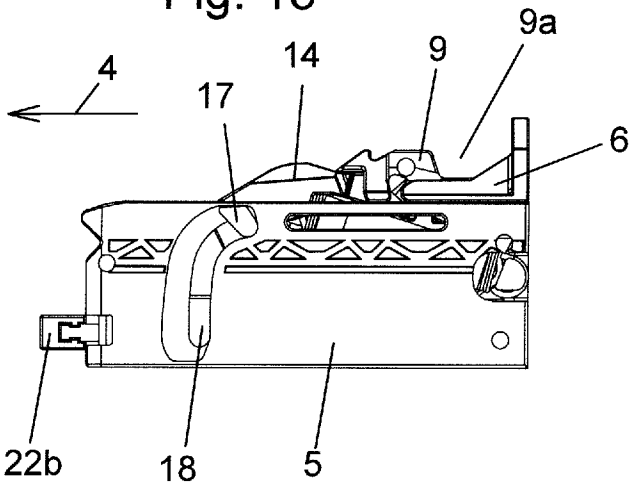
FIG. 13 shows a side view of the self-retracting device in the basic position of the carriage.
Figure 14:
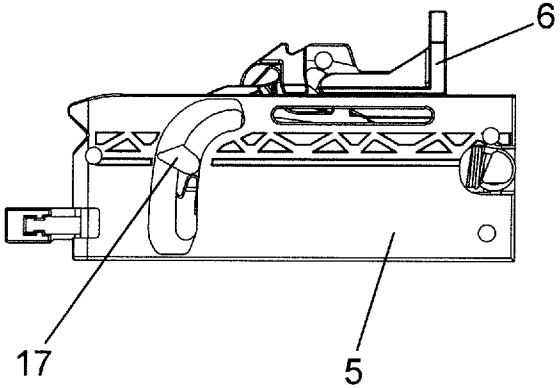
FIG. 14 shows a side view in a first intermediate position of the carriage slidably moved in the extraction direction relative to the basic position.
Figure 19:
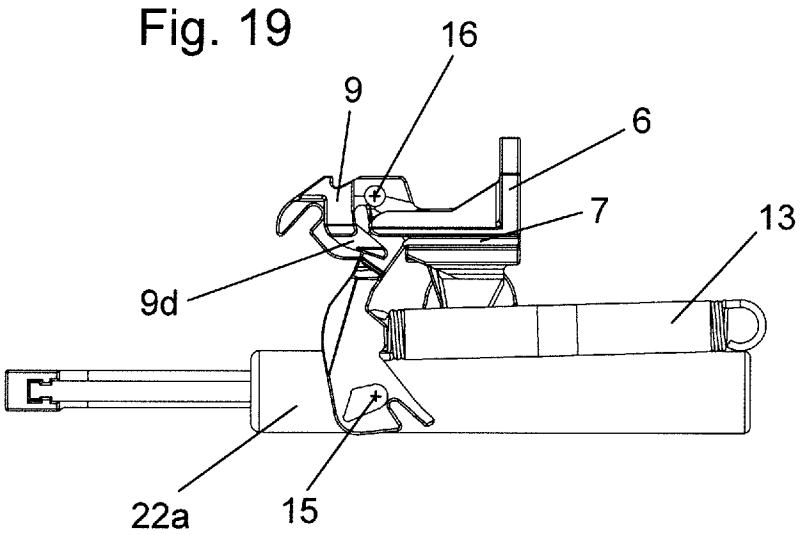
FIGS. 17 to 20 shows side views corresponding to FIGS. 13 to 16 without the base body of the retracting device.
Figure 20:
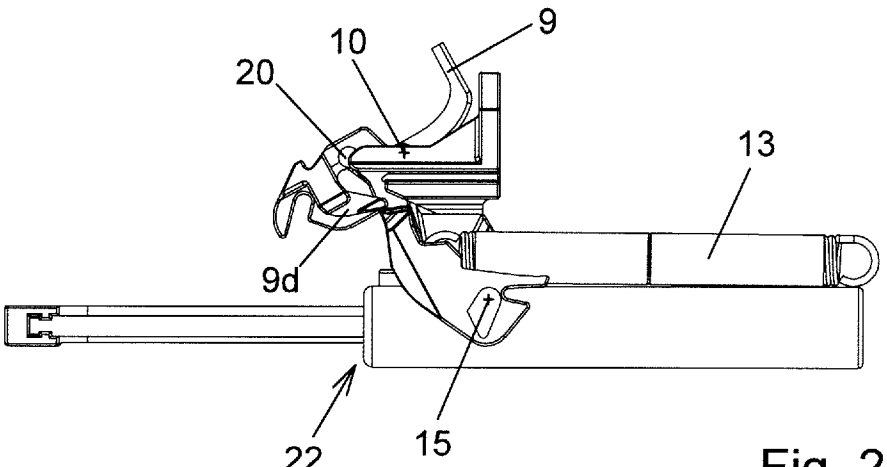
Figure 17:
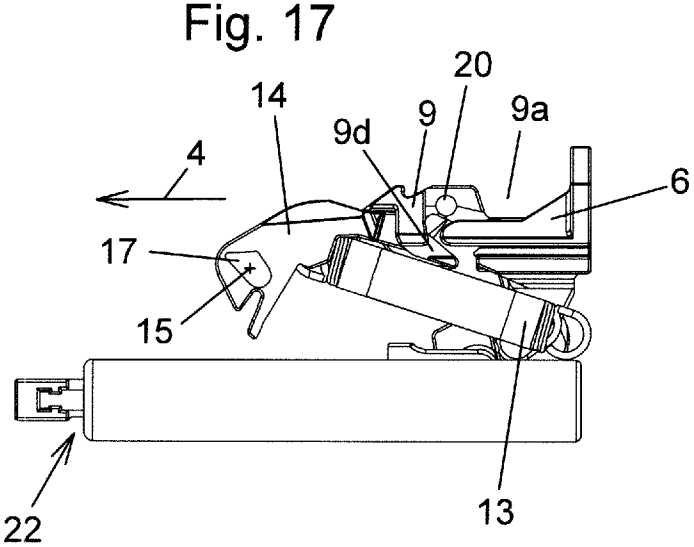
Figure 18:
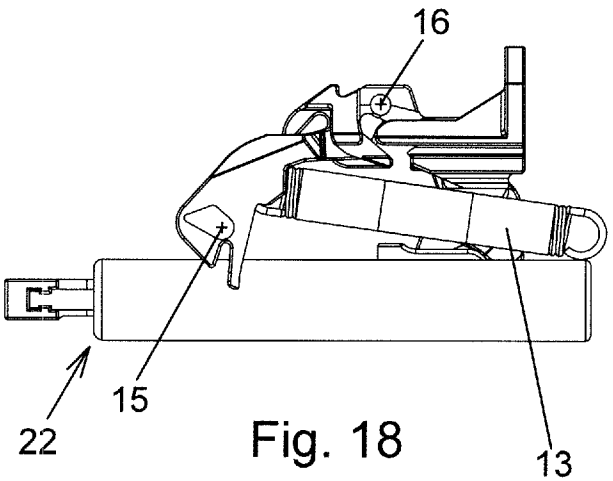
Figure 21:
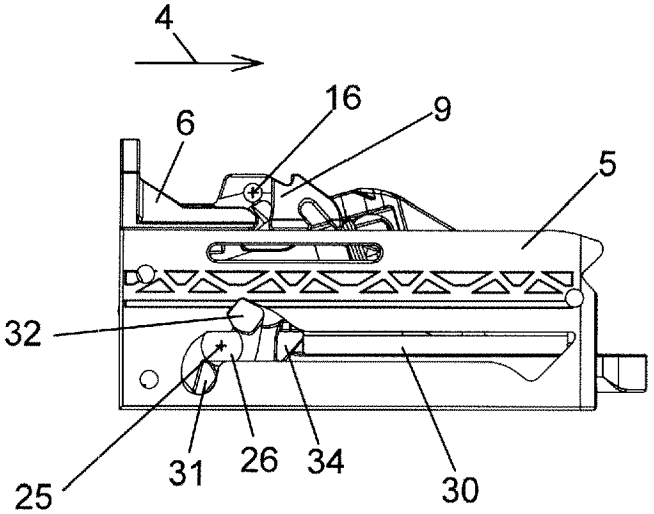
FIGS. 21 to 24 show side views of the opposite side of the self-retracting device in the positions of the carriage corresponding to FIGS. 13 to 16.
Figure 22:
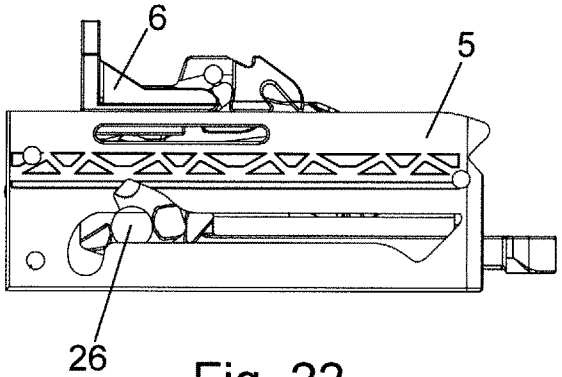
Figure 23:
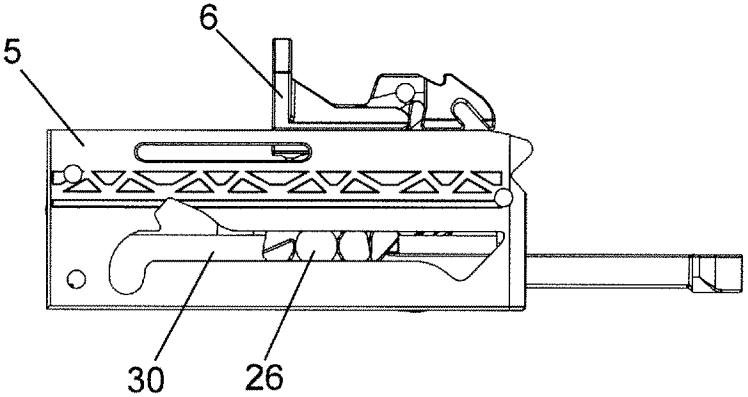
Figure 24:
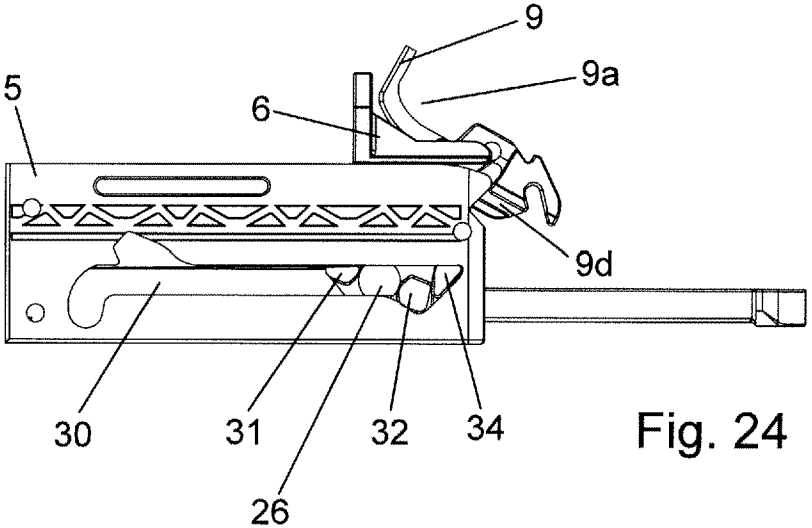
Figure 27:
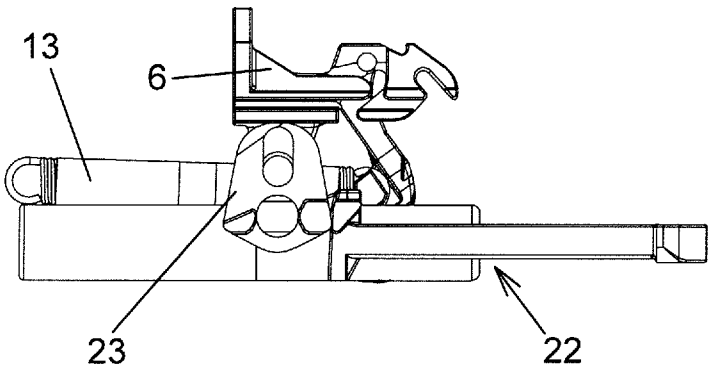
FIGS. 25 to 28 shows side views corresponding to FIGS. 21 to 24 without the base body of the self-retracting device.
Figure 28:
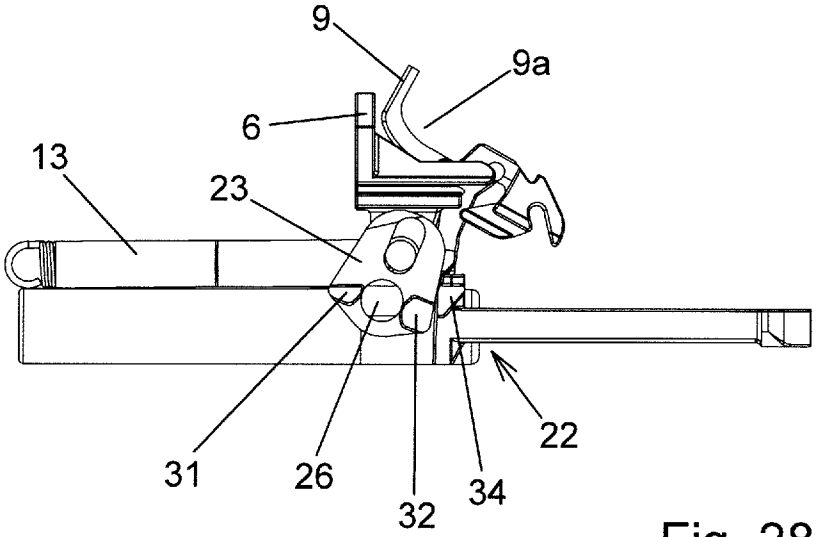
Figure 25:
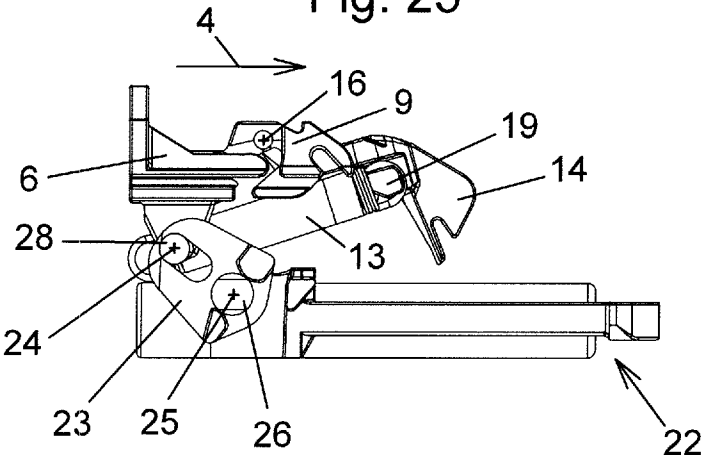
Figure 26:
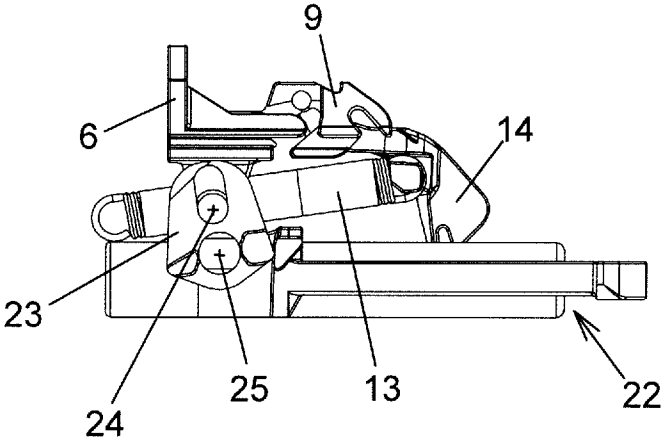

Driver 33, which cooperates via tilting part 9 with carriage 6, is formed in the example of embodiment by a portion of extraction rail 3, see FIG. 5. A web 3*a* of the profile projecting downwards, which forms extraction rail 3, comprises a projection forming driver 33 in the region of a rear end for this purpose.

In the basic position of carriage 6, in which tilting part 9 is in its engagement position, driver 33 engages in a recess 9*a* of the tilting part. Extraction rail 3 is in its completely insertion position here.

If extraction rail 3 is extracted from its completely inserted position in extraction direction 4, driver 33 pulls, by way of tilting part 9, carriage 6 from its basic position in extraction direction 4 against the force of retraction spring 13, which is transmitted via spring lever 14 to carriage 6, in the direction of its standby position. In the last portion of the sliding movement of carriage 6, until the latter reaches the standby position, tilting part 9 pivots about tilting axis 10 from its engagement position into the release position. In the release position, driver 33 can travel out of recess 9*a* of tilting part 9.

In the release position of tilting part 9, a retention section 9*b* of tilting part 9 abuts against a retention surface 5*a* of the base body. As a result of the abutment of retention section 9*b* against retention surface 5*a*, a sliding movement of the carriage out of the standby position in the direction of the basic position is blocked by the force of retraction spring 13. Carriage 6 thus remains in the standby position.

During the sliding movement of the carriage from the basic position in the direction of the standby position, the tilting part is first blocked by the base body against tilting about tilting axis 10, in particular by a slidable guidance of the tilting part parallel to extraction direction 4 by the base body. In the example of embodiment, grooves 9*d* on both sides of tilting part 9 engage into webs 8 of the base body. In the last portion of the sliding movement of carriage 6, before the latter reaches the standby position, grooves 9*d* travel out of the front ends of webs 8, so that the pivoting of tilting part 9 from the engagement position into the release position is enabled.

When, during the sliding-in of extraction rail 3, driver 33 runs up against stop surface 9*c* at the rear end of recess 9*a*, tilting part 9 is pivoted from the release position into the engagement position, in which driver 33 engages into recess 9*a* of tilting part 9. The sliding movement of carriage 6 in the direction of its basic position is thus released and retraction spring 13 pulls carriage 6 and with it driver 3 against extraction direction 4, until carriage 6 reaches the basic position. This movement of the carriage over the retraction path extending from the standby position to the basic position is damped by damping unit 22.

During the sliding movement of carriage 6 on the standby position in the direction of the basic position, in a first portion of the retraction path a rotation of arm 23 first takes place about an axis running perpendicular to the extraction direction, in the example of embodiment about second pivot axis 25. A transmission of the movement of carriage 6 to movable part 22*b* of damping unit 22 can thus be achieved. The distance of the sliding movement of carriage 6 against extraction direction 4 is thus greater than the distance of the sliding movement of movable part 22*b* of the damping unit. The onset of the damping effect of damping unit 22 thus takes place less abruptly.

This rotation of arm 23 in the initial portion of the retraction path could also be dispensed with. The protrusions of the slotted link in its front end portion could also be dispensed with.

A middle portion of the retraction path follows, over which arm 23 is slidably moved by carriage 6 against extraction direction 4 without rotation of arm 23. In this middle portion, a 1:1 transmission of the movement of carriage 6 to movable part 22*b* of the damping unit takes place.

In an end portion of the retraction path (=end portion of the movement of the carriage before it reaches its basic position) and therefore in an end portion of the movement of the arm before it reaches its rear end position, a further rotation of arm 23 (in the same direction of rotation is in the initial portion) takes place about the axis running perpendicular to the extraction direction, in the example of embodiment about second pivot axis 25. In the end portion of the retraction path, therefore, a reduction of the movement of carriage 6 to the movement of movable part 22*b* of damping unit 22 can thus be achieved. Over this end portion of the retraction path, the distance of the slidable movement of the carriage is thus greater than the distance of the slidable movement of movable part 22*b* of damping unit 22, preferably at least twice as great.

The rotation of arm 23 about the axis running perpendicular to extraction direction 4 (which is formed by second pivot axis 25 in the example of embodiment) is brought about by the force which is exerted on arm 23 in the region of its first pivot axis 24 by retraction spring 13 via the spring lever 14 and carriage 6.

The guidance of movable part 22*b* of the damping unit takes place in the example of embodiment by the engagement of axle pin 26 and a further guide pin 34 of movable part 22*b* in slotted link 30 of base body 5. Other types of slidable guidance can be provided, for example by way of a separate slotted link in the base body or by way of a strip on one of the two parts, which engages in a groove in the other of the two parts.

Figure 29:
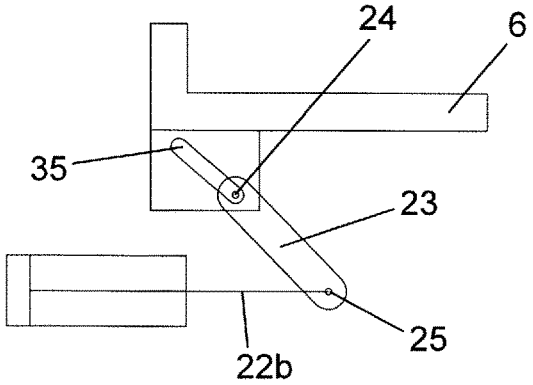
Figure 30:
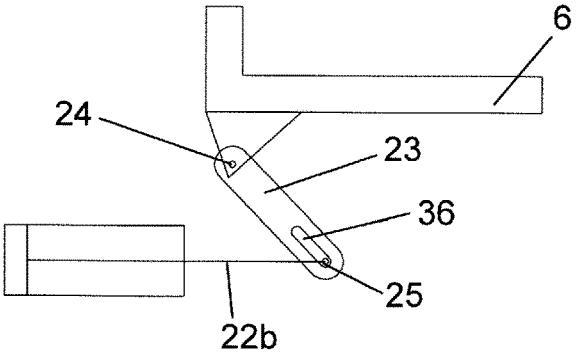
Figure 31:
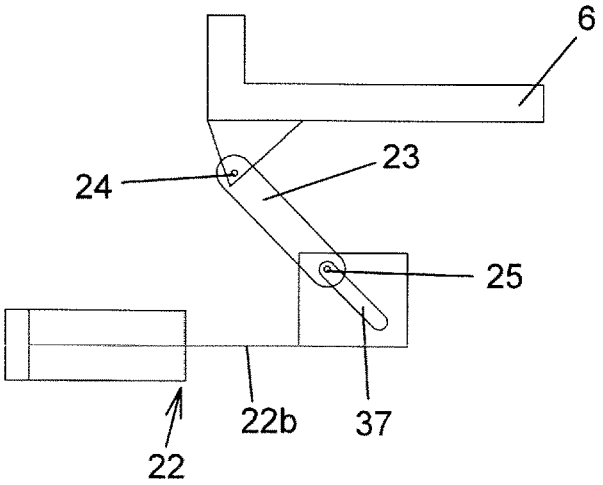

FIGS. 29 to 31 show very diagrammatically variants of embodiment of the coupling of carriage 6 with damping unit 22 via arm 23.

The movable and pivotable mounting of the arm on the base body is not represented in FIGS. 29 to 31. This can be constituted as described before.

According to FIG. 29, first pivot axis 24 can be moved slidably relative to carriage 6 (and is immovable with respect to arm 23), whilst second pivot axis 25 is immovable with respect to movable part 22*b* of damping unit 22 and arm 23. For the sliding movement of first pivot axis 24 with respect to carriage 6, the latter comprises for example an elongated hole 35, into which an axle pin of arm 23 engages.

According to FIG. 30, first pivot axis 24 is immovable with respect to carriage 6 and with respect to arm 23, whilst second pivot axis 25 can be moved slidably with respect to arm 23 and is immovable with respect to movable part 22*b*. For the sliding movement of second pivot axis 25 with respect to arm 23, the latter comprises for example an elongated hole 36, into which an axle pin of movable part 22*b* of damping unit 22 engages.

According to FIG. 31, first pivot axis 24 is immovable with respect to arm 23 and with respect to carriage 6, whilst second pivot axis 25 can be moved slidably with respect to movable part 22*b* of damping unit 22 and is immovable with respect to arm 23. For the sliding movement of second pivot axis 25 with respect to movable part 22*b* of damping unit 22, the latter comprises for example an elongated hole 37, into which an axle bolt of arm 23 engages.

In the variant of embodiment from FIG. 29, the rotation of arm 23 again takes place about second pivot axis 25, whilst in the variants of embodiment according to FIGS. 30 and 31 the rotation of arm 23 takes place about first pivot axis 24.

Figure 32:
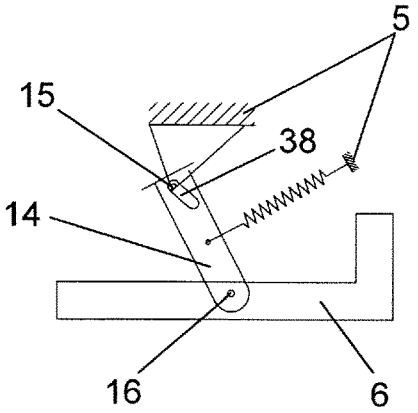
FIGS. 29 to 32 show very diagrammatic representations of modified variants of embodiment of the invention.

FIG. 32 shows in a very diagrammatic manner a modified embodiment of the transmission of the retraction force of retraction spring 13 to carriage 6. Spring lever 14 can be pivoted with respect to base body 5 again about a first pivot axis 15 and with respect to carriage 6 about a second pivot axis 16. First pivot axis 15 is immovable with respect to base body 5 and and can be moved slidably with respect to spring lever 14. For this purpose, spring lever 14 comprises for example a spring-lever slotted link 38, into which an axle pin of base body 5 engages.

Further modifications of the example of embodiment shown are conceivable and possible, without departing from the scope of the invention as it is defined in the claims. For example, both first pivot axis 24 and second pivot axis 25 can be moved slidably relative to one of the two parts, which are connected to one another via respective pivot axis 24, 25. The pivoting of arm 23 during its rotation would then take place about an imaginary axis running perpendicular to extraction direction 4 defined by the guidance of arm 23 on base body 5, which axis would again preferably lie horizontal.

The sliding movement of the carriage between the basic position and the standby position could also take place along a curved path. An overall tilting of the carriage could take place here, so that a separate tilting part could be dispensed with.

The invention claimed is:

1. A self-retracting device for a furniture part which can be extracted from a furniture carcass in an extraction direction by means of an extracting guide and inserted into the furniture carcass against the extraction direction, the self-retracting device comprising:

a carriage slidably supported by a base body from a basic position into a standby position, a retraction spring loading the carriage into the basic position, wherein the carriage is moved slidably by being coupled with a driver displaceable in the extraction direction against the force exerted by the retraction spring from the basic position into the standby position, in which the driver is uncoupled from the carriage and in which the carriage is retained against the force of the retraction spring, and a damping unit damping the sliding movement of the carriage from the standby position into the basic position, which comprises a movable part which is movable into and against the extraction direction and which is coupled with the carriage, wherein the carriage is coupled with the movable part of the damping unit by way of an arm, which is pivoted relative to the carriage about a first pivot axis and relative to the damping unit about a second pivot axis, wherein the first pivot axis is moved slidably relative to the arm or the carriage and/or the second pivot axis is moved slidably relative to the arm or the movable part of the damping unit, and the arm is guided by the base body between a rear end position, which the arm occupies in the basic position of the carriage, and a front end position, which the arm occupies in the standby position of the carriage, wherein, when the carriage is slidingly moved by the retraction spring over a retraction path from the standby position into the basic position of the carriage, a rotation of the arm about the second pivot axis running perpendicular to the extraction direction takes place at least in an end portion of the retraction path and the distance of the sliding movement of the carriage is greater than the distance of the sliding movement of the movable part of the damping unit over said end portion of the retraction path, wherein the first pivot axis is formed either by an axle pin arranged on the carriage, which is slidably supported in an elongated hole of the arm, or is formed by an axle pin arranged on the arm, which is slidably supported in an elongated hole of the carriage, and/or the second pivot axis is formed either by an axle pin arranged on the damping unit, which is slidably supported in an elongated hole of the arm, or is formed by an axle pin arranged on the arm, which is slidably supported in an elongated hole of the movable part of the damping unit.

2. The self-retracting device according to claim 1, wherein the base body comprises a slotted link for the guidance of the arm, into which at least one guide pin of the arm engages.

3. The self-retracting device according to claim 1, wherein the movable part of the damping unit is guided slidably by the base body parallel to the extraction direction.

4. The self-retracting device according to claim 1, wherein the carriage comprises a tilting part mounted pivotably about a pivot axis between an engagement position and a release position, wherein the tilting part in the basic position of the carriage is in the engagement position, in which the driver is coupled with the tilting part, and in the standby position of the carriage is tilted in the release position, in which uncoupling of the driver from the tilting part is enabled and the tilting part is retained by the base body against a sliding movement against the extraction direction.

5. An extracting guide comprising at least two rails slidably moved against one another, whereof one carcass rail of the at least two rails is fitted to a furniture carcass and whereof one extraction rail can be fitted to an extractable furniture part, wherein the extracting guide comprises the self-retracting device according to claim 1, wherein the base body is arranged on one of the rails of the extracting guide and the driver is arranged on another of the rails of the extracting guide.

6. A self-retracting device for a furniture part which can be extracted from a furniture carcass in an extraction direction by means of an extracting guide and inserted into the furniture carcass against the extraction direction, the self-retracting device comprising:

a carriage slidably supported by a base body from a basic position into a standby position, a retraction spring loading the carriage into the basic position, wherein the carriage is moved slidably by being coupled with a driver displaceable in the extraction direction against the force exerted by the retraction spring from the basic position into the standby position, in which the driver is uncoupled from the carriage and in which the carriage is retained against the force of the retraction spring, and a damping unit damping the sliding movement of the carriage from the standby position into the basic position, which comprises a movable part which is movable into and against the extraction direction and which is coupled with the carriage, wherein the carriage is coupled with the movable part of the damping unit by way of an arm, which is pivoted relative to the carriage about a first pivot axis and relative to the damping unit about a second pivot axis, wherein the first pivot axis is moved slidably relative to the arm or the carriage and/or the second pivot axis is moved slidably relative to the arm or the movable part of the damping unit, and the arm is guided by the base body between a rear end position, which the arm occupies in the basic position of the carriage, and a front end position, which the arm occupies in the standby position of the carriage, wherein, when the carriage is slidingly moved by the retraction spring over a retraction path from the standby position into the basic position of the carriage, a rotation of the arm about the second pivot axis running perpendicular to the extraction direction takes place at least in an end portion of the retraction path and the distance of the sliding movement of the carriage is greater than the distance of the sliding movement of the movable part of the damping unit over said end portion of the retraction path, and wherein the arm and the carriage are coupled in the front end position and in the rear and position of the arm.

7. A self-retracting device for a furniture part which can be extracted from a furniture carcass in an extraction direction by means of an extracting guide and inserted into the furniture carcass against the extraction direction, the self-retracting device comprising:

a carriage slidably supported by a base body from a basic position into a standby position, a retraction spring loading the carriage into the basic position, wherein the carriage is moved slidably by being coupled with a driver displaceable in the extraction direction against the force exerted by the retraction spring from the basic position into the standby position, in which the driver is uncoupled from the carriage and in which the carriage is retained against the force of the retraction spring, and a damping unit damping the sliding movement of the carriage from the standby position into the basic position, which comprises a movable part which is movable into and against the extraction direction and which is coupled with the carriage, wherein the carriage is coupled with the movable part of the damping unit by way of an arm, which is pivoted relative to the carriage about a first pivot axis and relative to the damping unit about a second pivot axis, wherein the first pivot axis is moved slidably relative to the arm or the carriage and/or the second pivot axis is moved slidably relative to the arm or the movable part of the damping unit, and the arm is guided by the base body between a rear end position, which the arm occupies in the basic position of the carriage, and a front end position, which the arm occupies in the standby position of the carriage, wherein, when the carriage is slidingly moved by the retraction spring over a retraction path from the standby position into the basic position of the carriage, a rotation of the arm about the second pivot axis running perpendicular to the extraction direction takes place at least in an end portion of the retraction path and the distance of the sliding movement of the carriage is greater than the distance of the sliding movement of the movable part of the damping unit over said end portion of the retraction path, wherein the retraction spring engages with a spring lever, which is pivoted relative to the base body about a first spring lever pivot axis and relative to the carriage about a second spring lever pivot axis, wherein the first spring lever pivot axis is slidably moved relative to the base body or relative to the spring lever.

8. The self-retracting device according to claim 7, wherein the first spring lever pivot axis is formed by an axle pin arranged either on the spring lever or on the base body, which is slidably supported in a spring-lever slotted link.

9. The self-retracting device according to claim 8, wherein the spring-lever slotted link has a curved course.

10. The self-retracting device according to claim 7, wherein the retraction spring engages with the spring lever in a region between the first spring lever pivot axis and the second spring lever pivot axis.

* * * * *